United States Patent [19]

Merritt

[11] 4,432,045

[45] Feb. 14, 1984

[54] LOW PROFILE OVERHEAD LIGHTING FIXTURE LENS SHIELD

[76] Inventor: William H. Merritt, 3812-32nd Ave. West, Seattle, Wash. 98199

[21] Appl. No.: 367,200

[22] Filed: Apr. 12, 1982

[51] Int. Cl.[3] ..... F21V 15/00

[52] U.S. Cl. ..... 362/375; 362/145; 362/329; 362/153; 362/335; 362/310; 362/376; 362/311; 362/431; 362/328; 362/453; 362/363

[58] Field of Search ..... 362/145, 307, 310, 329, 362/335, 374, 375, 431, 376, 453, 153, 311, 328, 363

[56] References Cited

U.S. PATENT DOCUMENTS

| | | | |
|---|---|---|---|
| 3,328,579 | 6/1967 | Green | 362/375 X |
| 3,661,685 | 5/1972 | Osteen | 362/431 X |
| 3,808,423 | 4/1974 | Adam | 362/310 |
| 3,832,538 | 8/1974 | Adam | 362/310 |
| 3,836,954 | 9/1974 | Adam | 362/363 |
| 4,010,362 | 3/1977 | Fletcher | 362/375 |
| 4,104,712 | 8/1978 | Häfner | 362/294 X |
| 4,160,286 | 7/1979 | Merritt | 362/311 |
| 4,319,313 | 3/1982 | Eberhart et al. | 362/375 X |
| 4,320,443 | 3/1982 | Zwillich | 362/375 X |

*Primary Examiner*—Peter A. Nelson

*Attorney, Agent, or Firm*—Robert W. Beach; Ward Brown

[57] ABSTRACT

A transparent shallow gently bulging substantially spherical segmental shield formed of polycarbonate resin protects a planar lens mounted in an aperture in a door of a conventional low profile streetlight. The shield shell is generally of the shape of a convex spherical segment with an altitude between one-eighth and one-fourth of the length of its base chord and has an external marginal flange. The curvature of the shell may be sharper adjacent to its margin than at its center. The shell may include a vent aperture to drain condensate liquid from the interior of the streetlight.

4 Claims, 6 Drawing Figures

LOW PROFILE OVERHEAD LIGHTING FIXTURE LENS SHIELD

BACKGROUND OF THE INVENTION

1. Field of the Invention

The present invention relates to a low profile overhead lighting fixture, such as a streetlight, or luminaire, and more particularly to a lens shield for such luminaire.

2. Prior Art

Lenses are customarily provided to cover the aperture emitting light from the light-producing means of a luminaire to protect and perhaps to diffuse light from such light-producing means. Usually such lenses are made of glass, and, hence, are subject to vandalistic breakage. Such breakage necessitates replacement of lenses and also may subject persons in the area of a luminaire to injury due to the broken glass of the lens.

In my prior U.S. Pat. No. 4,160,286, a transparent hemispherical shield formed of polycarbonate resin plastic was mounted to cover a bulging bowl-shaped light-diffusing glass lens of a luminaire to protect such lens. The hemispherical shape was chosen because it is structurally strong and is of a size to shroud and be spaced a substantial distance outward from the bulging light-diffusing lens so that there is less chance of the plastic shield being discolored or deformed by heat or ultraviolet radiation. However, such a hemispherical shield would destroy the esthetic low profile character of a luminaire having a substantially flat lens.

SUMMARY OF THE INVENTION

It is an object of the present invention to provide a practical low profile shield for a substantially flat lens of a low profile luminaire.

It is also an object to provide a shield which is of such a material and shape that it will effectively protect the flat lens of a low profile luminaire from projectiles without greatly increasing the thickness of the low profile luminaire.

The foregoing objects can be accomplished by providing a low profile luminaire shield in the form of a pan shield having a central bulge generally in the shape of a spherical segment with an altitude preferably between 14% and 20% of the diameter of the segment base.

DETAILED DESCRIPTION

Figure 1:
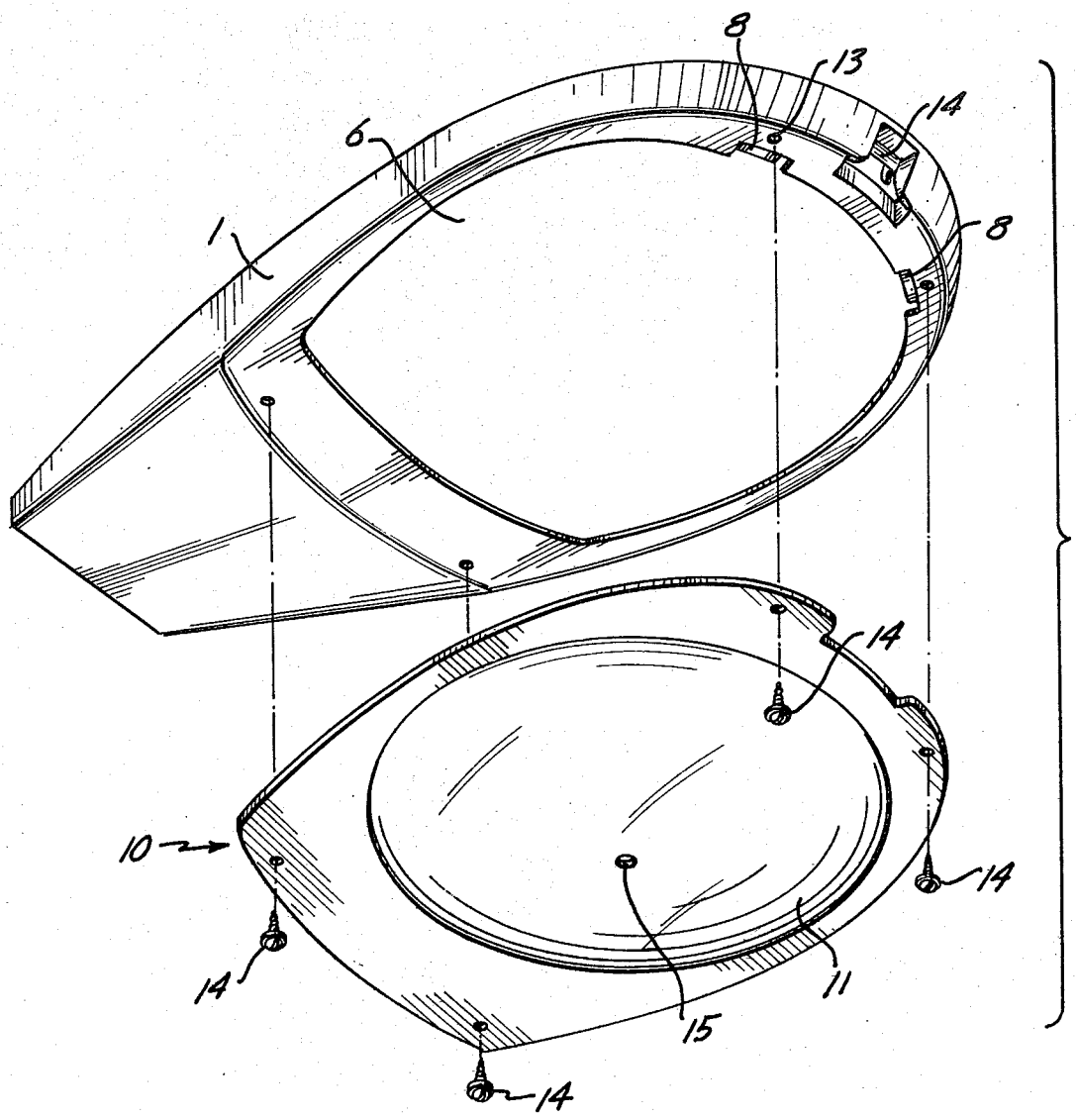
FIG. 1 is an exploded bottom perspective of a conventional low profile streetlight door, and a shield and shield-mounting screws in accordance with the present invention.

In a conventional low profile streetlight luminaire, a door 1 is swingably connected to a body 2 by a hinge 3, which body encircles light-producing means. A latch 4 mounted in a latch cavity 5 in the door 1 can attach to the body the portion of the door remote from its hinge. The door includes an aperture 6 of noncircular profile, the upper margin of which is contacted by the margin of a conventional substantially planar glass lens 7 of noncircular profile matching the shape of the aperture 6 which closes the opening. Movement of the lens upward away from the cover frame is prevented by lugs 8 overhanging one end of the lens and a pivoted latch finger 9 overhanging the other end of the lens.

According to the present invention, a transparent shield 10 in the shape of a shallow shell is provided at the other side of the lens 7 to protect the lens of the streetlight. Such shield should be made of a strong plastic material and shape which has high impact strength, high heat resistance and dimensional stability. Polycarbonate resin plastic of a thickness of 0.10 inch (2.54 mm) to 0.16 inch (4.06 mm), preferably 0.14 inch (3.56 mm), has been found to be a satisfactory shield material and can be molded into the desired shape.

To provide a shield for the planar lens 7 and maintain the low profile of the streetlight, a planar shield might be provided to overlie the lens. The difficulty with such a proposal, however, is that, in order to prevent the flat shield from buckling or deflecting into engagement with the lens, which might break the lens, it would be necessary either to make the shield extremely thick to provide sufficient rigidity or to mount the planar shield spaced from the lens a distance sufficient so that the shield could not buckle or deflect into engagement with the lens. If polycarbonate resin plastic were to be made sufficiently rigid to avoid such buckling or deflection, it would be necessary for the sheet to be quite thick, such as perhaps ½ inch (1.27 cm), which would make the sheet undesirably heavy as well as expensive.

The other alternative of utilizing a thinner sheet of polycarbonate material, such as within the range of thickness discussed above, and spacing the flat sheet out from the lens a considerable distance, such as perhaps three or four inches (7½ to 10 centimeters) would provide difficulties of mounting, would look unsightly and would increase the weight of the shield structure.

The present invention avoids such difficulties of excessive shield sheet thickness and unsightly appearance by utilizing a gently bulging shell having a central portion of generally circular plan shape. The central portion of shell 11 is in the shape of a convex substantially spherical segment or curve of revolution about the altitude of the shield perpendicular to the lens as an axis with an altitude between one-eighth and one-fourth of the length of the chord of its base. Preferably the altitude is between 14% and 20% of the base diameter or chord. Such a shell will protect the lens and light-producing means of a low profile luminaire including a substantially planar lens without excessive discoloration or deformation by heat and ultraviolet radiation emitted by the light-producing means. Moreover, the shield possesses ample strength to resist penetration by rocks and bullets and, by limiting the altitude of the shell to one-fourth of the length of the maximum chord of the shell, the low profile of the luminaire is preserved.

Figures 2, 3, 4, 5, 6:
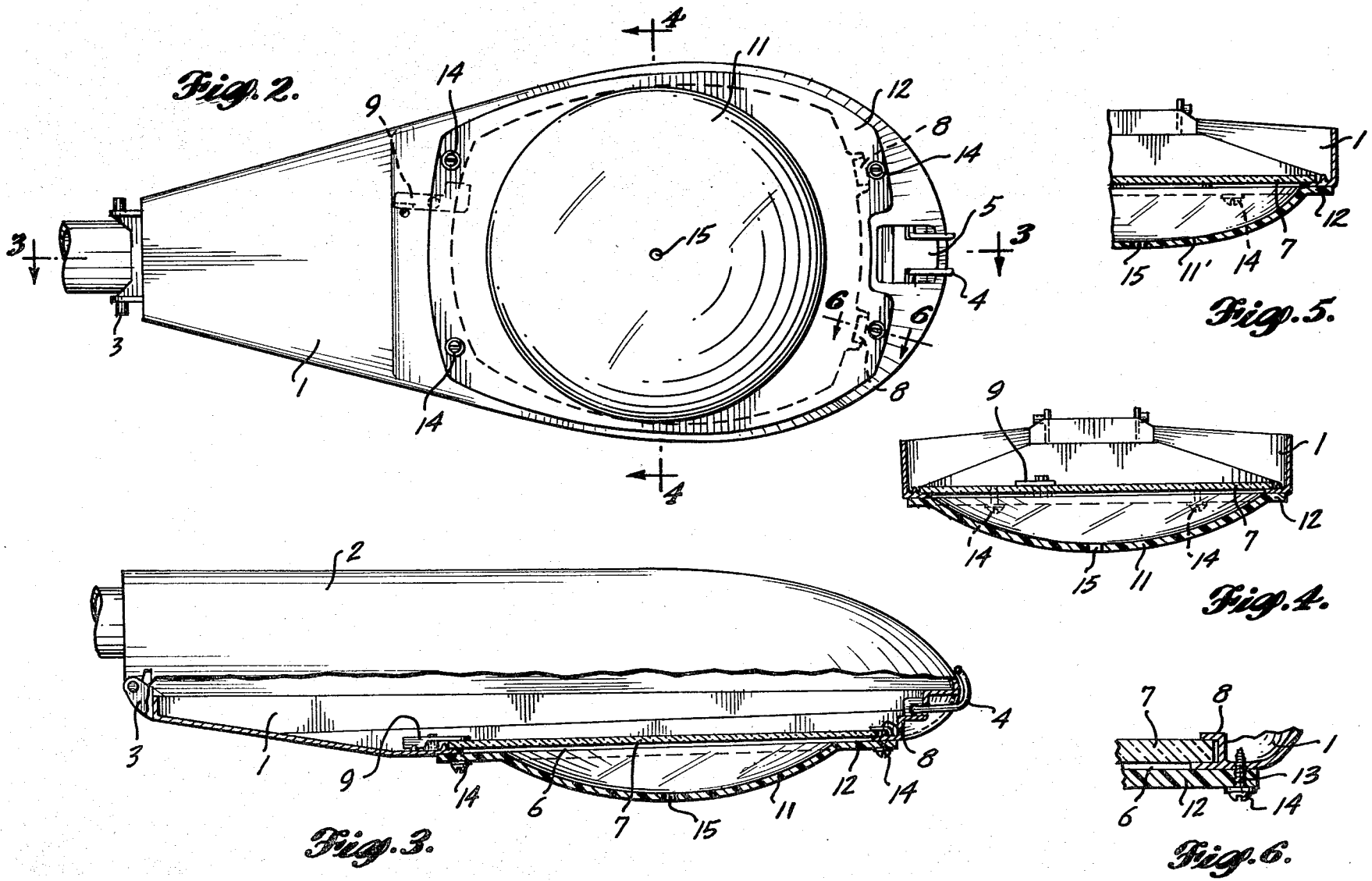
FIG. 2 is a bottom plan of a streetlight having a shield in accordance with the present invention.
FIG. 3 is a side elevation of the streetlight with parts broken away and parts shown in section taken along line 3—3 of FIG. 2.
FIG. 4 is a section taken on line 4—4 of FIG. 2.
FIG. 5 is an enlarged fragmentary detail section of a second embodiment in which the curvature of the streetlight shell is sharper adjacent to its margin that at its center.
FIG. 6 is an enlarged fragmentary detail section taken on line 5—5 of FIG. 2 with parts broken away.

The shield 10 has an external flange 12 projecting outward from the margin of the central portion to compensate for the differences in shape of the door aperture 6 and the shield bulge margin. Whether the substantially circular plan shape of the bulging shell 11 is precisely circular or has a major axis somewhat longer than its minor axis, the flange can be formed integrally with the convex shell, or it can be cut from a flat sheet and bonded to the margin of the shell by heat-sealing, solvent-sealing or gluing. As best seen in FIGS. 1 and 2, the flange 12 is of varying width extends beyond the aperture 6 of the door and the margin of the lens 7 and has a maximum width at least as great as one quarter of the radius of the spherical segment central portion.

If the curvature of the shield is sharper adjacent to its margin than at its center, as shown in the FIG. 5 embodiment, or the central portion of the shell is otherwise offset abruptly from its marginal flange, the distance between the shield and the major portion of the lens area is increased for deterring discoloration and resisting deformation of the central portion of the shield under load or impact while preserving the general low profile of the luminaire and shield.

To install the shield 10, holes 13 shown in FIG. 1 are drilled in the door 1 of the streetlight frame outwardly of the perimeter of the lens 7 as best seen in FIG. 2. The shield flange is secured to the door at the side of lens 7 opposite the light source by sheet metal screws or tapping screws 14 which screw into the holes 13.

Occasionally rain will seep into the frame of the streetlight or moisture will condense within the frame of the streetlight. To alleviate this problem the shield 10 may be have a vent aperture 15 at the center of the shell to drain liquid from the shell.

I claim:

1. A low profile overhead luminaire including a body having an aperture of noncircular profile and light-producing means encircled by the body comprising the combination of a transparent substantially planar glass lens of noncircular profile matching the shape of the aperture and mounted to the body covering the aperture, a transparent shallow gently bulging strong plastic shell of noncircular profile similar to the shape of the aperture and having a central portion substantially in the form of a convex spherical segment with an altitude no more than one-fourth the length of its base chord and having an external flange integral with said central portion, said flange being of varying width, projecting outward from the margin of said central portion and having a maximum width at least as great as one quarter of the radius of said spherical segment central portion, and means for securing said flange to the body at the outer side of said lens.

2. The luminaire defined in claim 1, in which the shell and flange are polycarbonate resin of a thickness of 0.10 inch (2.54 mm) to 0.16 inch (4.06 mm).

3. The luminaire defined in claim 1, in which the altitude of the shell is between one-eighth and one-quarter of the length of its base chord.

4. The luminaire defined in claim 1, in which the altitude of the shell is between 14% and 20% of the length of its base chord.

* * * * *